US010208727B2

(12) United States Patent
Marrack et al.

(10) Patent No.: US 10,208,727 B2
(45) Date of Patent: Feb. 19, 2019

(54) FLUID CONDITIONING MODULE

(71) Applicant: Caterpillar Inc., Peoria, IL (US)

(72) Inventors: Andrew O. Marrack, Peoria, IL (US); Scott F. Shafer, Morton, IL (US); Martin A. Lehman, Congerville, IL (US); Kenneth C. Adams, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 580 days.

(21) Appl. No.: 14/980,318

(22) Filed: Dec. 28, 2015

(65) Prior Publication Data

US 2017/0184110 A1 Jun. 29, 2017

(51) Int. Cl.

| | |
|---|---|
| ***F02M 37/00*** | (2006.01) |
| ***F02M 37/18*** | (2006.01) |
| ***F02M 63/02*** | (2006.01) |
| ***F02M 37/22*** | (2006.01) |
| ***F04D 13/12*** | (2006.01) |
| ***F04D 13/14*** | (2006.01) |
| ***F04D 15/00*** | (2006.01) |
| ***F04B 23/10*** | (2006.01) |
| ***F04B 23/14*** | (2006.01) |

(Continued)

(52) U.S. Cl.

CPC .... *F02M 63/0225* (2013.01); *F02M 37/0052* (2013.01); *F02M 37/18* (2013.01); *F02M 37/22* (2013.01); *F04B 23/10* (2013.01); *F04B 23/14* (2013.01); *F04C 11/005* (2013.01); *F04D 13/12* (2013.01); *F04D 13/14* (2013.01); *F04D 15/0072* (2013.01); *F04C 14/24* (2013.01)

(58) Field of Classification Search

CPC .... F02M 37/22; F02M 37/18; F02M 37/0052; F02M 63/0225; F04B 23/04; F04B 23/06; F04B 23/08; F04B 23/10; F04B 23/14; F04D 13/12; F04D 13/14; F04D 15/0072

See application file for complete search history.

(56) References Cited

U.S. PATENT DOCUMENTS 6,253,734 B1 * 7/2001 Rembold ..... F02D 41/3845 123/446

6,322,694 B1 11/2001 Iliadis et al.

(Continued)

FOREIGN PATENT DOCUMENTS

| | | |
|---|---|---|
| JP | 2013117186 | 6/2013 |
| WO | 2014148987 | 9/2014 |

*Primary Examiner* — Peter J Bertheaud

(57) ABSTRACT

A fluid conditioning module having a fluid inlet and a fluid outlet is provided. The fluid conditioning module includes a first pump element, a second pump element, a pressure regulator, a controller, and a prime mover to impart rotational motion in the first and second pump elements. A first pump inlet is in fluid communication with the fluid inlet. A filter inlet is in fluid communication with a first pump outlet and a second pump outlet, and a filter outlet is in fluid communication with the fluid outlet. A pressure regulator inlet and a pressure regulator outlet are in fluid communication with the filter outlet and a recirculation conduit, respectively. The control valve has a first position and a second position, which allows fluid flow through the recirculation conduit. The controller adjusts operation of one or more of the prime mover and the control valve based upon a predetermined parameter.

18 Claims, 2 Drawing Sheets

(51) Int. Cl.
*F04C 11/00* (2006.01)
*F04C 14/24* (2006.01)

(56) References Cited

U.S. PATENT DOCUMENTS

| | | | | |
|---|---|---|---|---|
| 6,792,915 | B2 * | 9/2004 | Rembold | F02M 37/0052 123/446 |
| 7,044,110 | B2 * | 5/2006 | Geyer | F02M 53/00 123/456 |
| 8,844,503 | B2 | 9/2014 | Worthington et al. | |
| 9,909,468 | B2 * | 3/2018 | Lehman | F01M 1/12 |
| 9,957,940 | B2 * | 5/2018 | Shafer | F02M 63/0265 |
| 10,029,193 | B2 * | 7/2018 | Lehman | B01D 29/56 |
| 2004/0103883 | A1 | 6/2004 | Geyer | |
| 2004/0118764 | A1 | 6/2004 | Miller et al. | |
| 2009/0145823 | A1 | 6/2009 | Lauer et al. | |
| 2012/0216778 | A1 | 8/2012 | Fulton et al. | |
| 2012/0255521 | A1 | 10/2012 | Aoki et al. | |
| 2014/0021118 | A1 | 1/2014 | Shafer et al. | |
| 2014/0183112 | A1 | 7/2014 | Ahmad | |

* cited by examiner

FLUID CONDITIONING MODULE

TECHNICAL FIELD

The present disclosure is related to a fluid delivery system of a machine, and more particularly to a fluid conditioning module for the fluid delivery system.

BACKGROUND

Fluid delivery systems are used to transfer fluids, for example lubrication oil, fuel, diesel exhaust fluid, etc., in machines associated with various applications such as, agriculture, construction, and the like. A typical fluid delivery system includes a tank, a pump, and a filter assembly. The pump is used to transfer fluid from the tank via the filter assembly. The fluid stored in the tank may contain contaminants that may damage one or more components of a machine. Therefore, the filter assembly is provided which includes at least one filter element that filters the contaminants from the fluid. In order to obtain a desired level of filtration, the fluid may be recirculated through the filter element.

For reference, U. S. publication number 2014/0021118 discloses a fuel filtration system, a filter exchange module, and a method of replacing fuel filters. The fuel filtration system includes an electric pump, a filter assembly, and one or more conduits for fluidly connecting the electric pump and the filter assembly in series with a fuel tank to define a kidney filtration loop.

SUMMARY

In one aspect of the present disclosure, a fluid conditioning module is disclosed. The fluid conditioning module has a fluid inlet configured for fluid communication with a fluid reservoir and a fluid outlet. The fluid conditioning module includes a first pump element having a first pump inlet and a first pump outlet. The first pump inlet is in fluid communication with the fluid inlet of the module. The fluid conditioning module includes a filter mount having a filter inlet and a filter outlet. The filter inlet is in fluid communication with the first pump outlet and the filter outlet is in fluid communication with the fluid outlet. The fluid conditioning module includes a pressure regulator having a pressure regulator inlet and a pressure regulator outlet. The pressure regulator inlet is in fluid communication with the filter outlet and the pressure regulator outlet is in fluid communication with a recirculation conduit. The fluid conditioning module includes a control valve disposed in the recirculation conduit, the control valve having a first position and a second position. Fluid flow is allowed through the recirculation conduit when the control valve is in the first position.

In another aspect of the present disclosure, a fluid conditioning module is disclosed. The fluid conditioning module includes a first pump element having a first pump inlet and a first pump outlet. The first pump inlet is in fluid communication with the fluid inlet of the fluid conditioning module. The fluid conditioning module includes a second pump element having a second pump inlet and a second pump outlet. The second pump inlet is in fluid communication with the filter inlet. The fluid conditioning module includes a prime mover connected to the first pump element and the second pump element. The prime mover is configured to impart rotational motion to a first impeller in the first pump element and a second impeller in the second pump element. The fluid conditioning module includes a filter mount having a filter inlet and a filter outlet. The filter inlet is in fluid communication with the first pump outlet and the second pump outlet. The filter outlet is in fluid communication with the fluid outlet. The fluid conditioning module includes a pressure regulator having a pressure regulator inlet and a pressure regulator outlet. The pressure regulator inlet is in fluid communication with the filter outlet and the pressure regulator outlet is in fluid communication with a recirculation conduit. The fluid conditioning module includes a control valve disposed in the recirculation conduit. The control valve has a first position and a second position. Fluid flow is allowed through the recirculation conduit when the control valve is in the first position. The fluid conditioning module includes a controller in operative communication with one or more of the prime mover and the control valve. The controller is configured to adjust operation of one or more of the prime mover and control valve based upon a predetermined parameter.

In yet another aspect of the present disclosure, a fluid delivery system for a machine is disclosed. The fluid delivery system includes a fluid reservoir. The fluid delivery system also includes a fluid conditioning module having a fluid inlet configured for fluid communication with the fluid reservoir and a fluid outlet. The fluid conditioning module includes a first pump element having a first pump inlet and a first pump outlet. The first pump inlet is in fluid communication with the fluid inlet of the fluid conditioning module. The fluid conditioning module includes a second pump element having a second pump inlet and a second pump outlet. The second pump inlet is in fluid communication with the filter inlet. The fluid conditioning module includes a prime mover connected to the first pump element and the second pump element. The prime mover is configured to impart rotational motion to a first impeller in the first pump element and a second impeller in the second pump element. The fluid conditioning module includes a filter mount having a filter inlet and a filter outlet. The filter inlet is in fluid communication with the first pump outlet and the second pump outlet. The filter outlet is in fluid communication with the fluid outlet. The fluid conditioning module includes a pressure regulator having a pressure regulator inlet and a pressure regulator outlet. The pressure regulator inlet is in fluid communication with the filter outlet and the pressure regulator outlet is in fluid communication with a recirculation conduit. The fluid conditioning module includes a control valve disposed in the recirculation conduit. The control valve has a first position and a second position. Fluid flow is allowed through the recirculation conduit when the control valve is in the first position. The fluid conditioning module includes a controller in operative communication with one or more of the prime mover and the control valve. The controller is configured to adjust operation of one or more of the prime mover and control valve based upon a predetermined parameter.

Other features and aspects of this disclosure will be apparent from the following description and the accompanying drawings.

DETAILED DESCRIPTION

Wherever possible the same reference numbers will be used throughout the drawings to refer to same or like parts.

Moreover, references to various elements described herein, are made collectively or individually when there may be more than one element of the same type. However, such references are rendered to merely aid the reader's understanding of the present disclosure and hence, to be considered exemplary in nature. Accordingly, it may be noted that any such reference to elements in the singular is also to be construed to relate to the plural and vice versa without limiting the scope of the disclosure to the exact number or type of such elements unless set forth explicitly in the appended claims.

Figure 1:
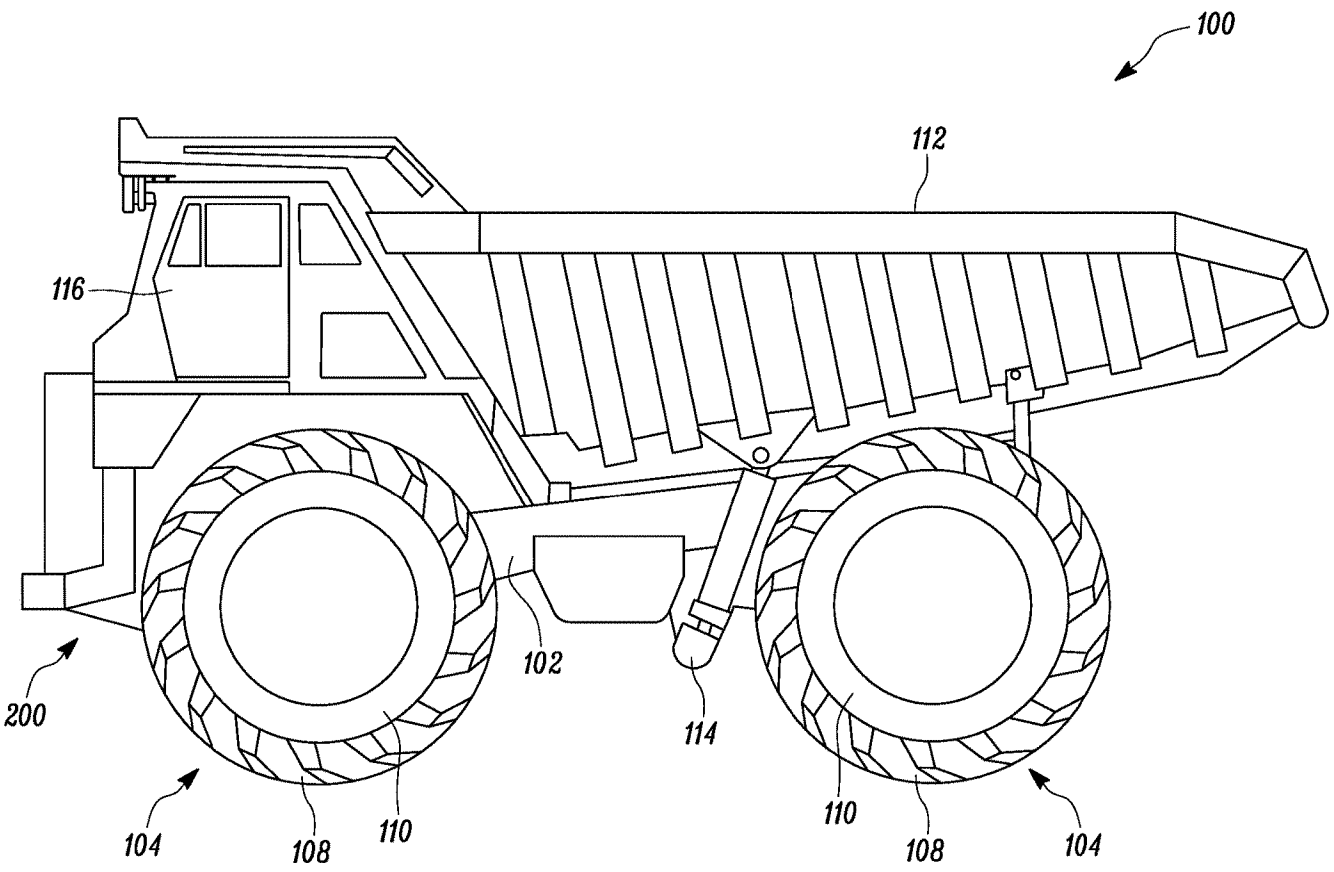
FIG. 1 is a side view of an exemplary machine embodied as a vehicle.

FIG. 1 illustrates an exemplary machine 100 that is embodied in the form of a wheeled vehicle, for e.g., a mining truck (as shown). The machine 100 may be used in a variety of applications including mining, road construction, construction site preparation, etc. For example, the mining truck of the present disclosure may be employed for hauling earth materials such as soil, debris, or other naturally occurring deposits from a worksite. Although a mining truck is depicted in FIG. 1, other types of mobile machines such as, but not limited to, large wheel loaders, off highway trucks, articulated trucks, on-highway trucks, tracked vehicles, for example excavators, dozers, shovels may be employed in lieu of the mining truck. Alternatively, the machine 100 may also be a stationary machine, for example a generator that may be adapted to generate electricity.

The machine 100 includes a frame 102, multiple wheel assemblies 104, and an engine system 200. Each of the wheel assemblies 104 includes a wheel 108 mounted to a wheel hub 110. The wheel hub 110 is rotatably supported on the frame 102. Further, the machine 100 may also include a payload bed 112 and a hoist cylinder 114 that can be used to lift the payload bed 112 relative to the frame 102. In some applications, there may be more than one hoist cylinders associated with the machine 100. The machine 100 also includes an operator cab 116 disposed on the frame 102. The operator cab 116 may include a plurality of operator controls and displays (not shown) that are configured to operate the machine 100 and the payload bed 112. The engine system 200 provides propulsion power to the wheel assemblies 104 and may also power other machine systems, including various mechanical, electrical, and hydraulic systems and/or components.

Figure 2:
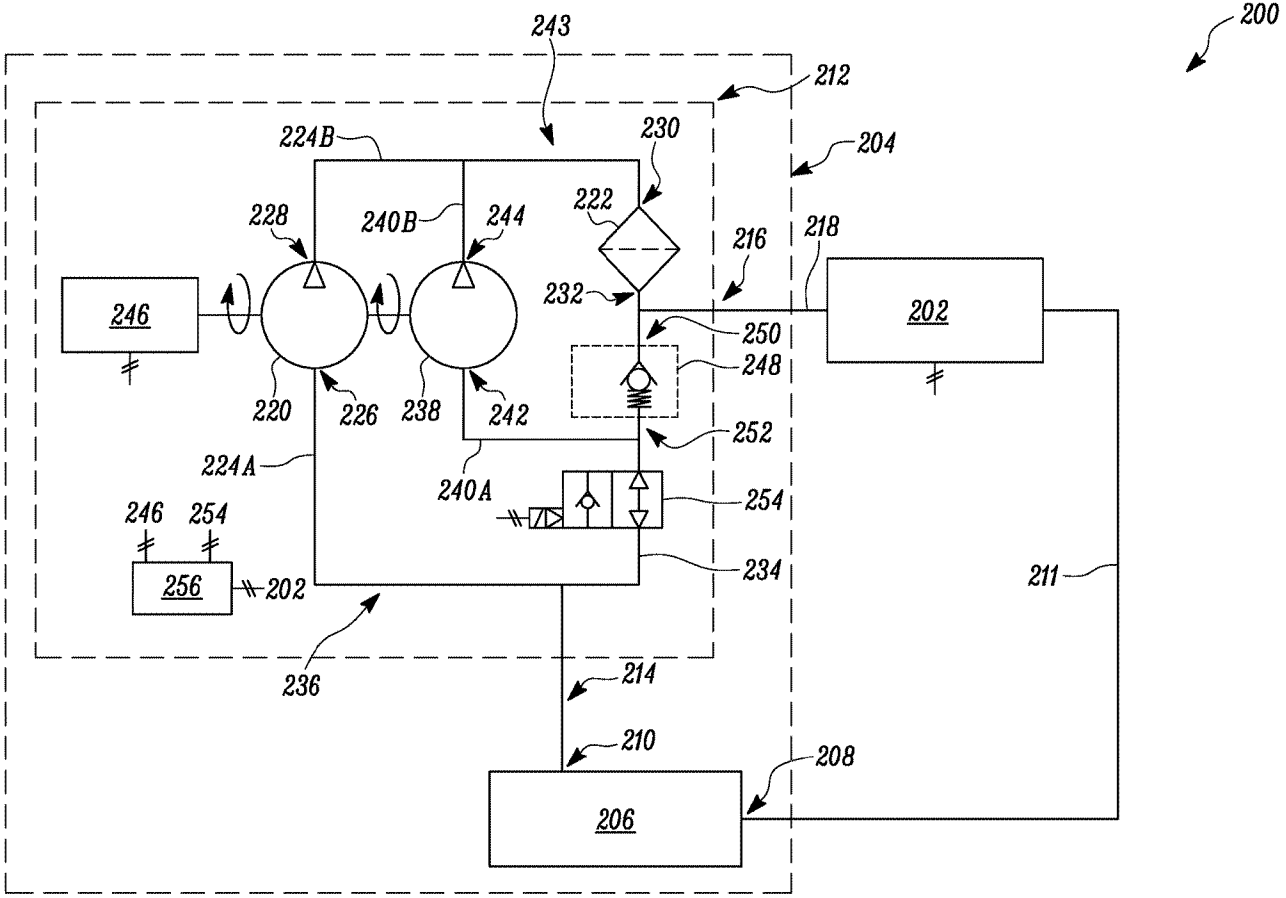
FIG. 2 is a diagrammatic representation of a fluid delivery system that can be employed by the exemplary machine of FIG. 1.

Referring to FIG. 2, a diagrammatic view of the engine system 200 is illustrated in accordance with an embodiment of the present disclosure. The engine system 200 includes an internal combustion engine 202 for power production. The internal combustion engine 202 may be a fuel-based engine to power the machine 100 by combustion of fuel, such as gasoline, diesel, or any other petroleum products. Moreover, the internal combustion engine 202 may be a gasoline engine, a diesel engine, or any other kind of engine utilizing combustion of fuel for generation of power. Therefore, any type of fuel commonly known in the art may be used without deviating from the spirit of the present disclosure. The internal combustion engine 202 may be configured to operate in a normal operating condition and a priming operating condition. In normal operating condition, fuel may be injected, via multiple fuel injectors (not shown), into one or more combustion chambers for combustion and thereby propelling the machine 100. Further, in the priming operating condition, fuel may be sprayed into the combustion chambers at the start of the internal combustion engine 202. The priming operating condition may also refer to spraying of fuel during maintenance and/or serving of the internal combustion engine 202. A higher level of fuel filtration may be desired during the normal operating condition than the priming operating condition of the internal combustion engine 202. The present disclosure relates to a fluid delivery system 204 that is embodied as a fuel delivery system of the engine system 200. Additionally or alternatively, the fluid delivery system 204 may be also be conveniently implemented in various other fluid systems of the machine 100.

In an embodiment, the fluid delivery system 204 may be in fluid communication with the injectors for providing fluid to the internal combustion engine 202. In another embodiment, the fluid delivery system 204 may be in fluid communication with a fuel storage rail (not shown) of the internal combustion engine 202.

The fluid delivery system 204 may include a fluid reservoir 206 having a tank inlet 208 and a tank outlet 210. In an exemplary embodiment, the fluid reservoir 206 is a fuel tank of the machine 100. The tank inlet 208 is in fluid communication with the internal combustion engine 202, via a fluid return conduit 211. The fluid delivery system 204 further includes a fluid conditioning module 212 in fluid communication with the internal combustion engine 202 and the fluid reservoir 206. The fluid conditioning module 212 has a fluid inlet 214 configured for fluid communication with the tank outlet 210, and a fluid outlet 216 configured for fluid communication with the internal combustion engine 202, via a fluid outlet conduit 218. The fluid conditioning module 212 is configured to cooperate with a petroleum distillate fluid, such as gasoline, diesel, natural gas, petroleum gas or the like.

As shown in FIG. 2, the fluid conditioning module 212 includes a first pump element 220 and a filter mount 222 that are connected in series with the fluid reservoir 206 using a set of conduits 224A, 224B. The first pump element 220 has a first pump inlet 226 that is in fluid communication with the fluid inlet 214, via the conduit 224A, and a first pump outlet 228 that is in fluid communication with the filter mount 222, via the conduit 224B. The first pump element 220 includes a first impeller (not shown) that may be rotated at a rotational speed to increase a flow rate and a pressure of the fluid flowing therethrough. In an exemplary embodiment, the first pump element 220 is a positive displacement pump. The first pump element 220 may be any type of positive displacement pump, such as a rotary-type displacement pump, a reciprocating-type positive displacement pump, a linear-type positive displacement pump. Further, during operation of the first pump element 220, a fluid flow is obtained from the fluid reservoir 206 to the filter mount 222 due to a rotation of the first impeller.

Further, the filter mount 222 has a filter inlet 230 that is connected to the first pump outlet 228, via the conduit 224B, and a filter outlet 232 that is connected to the fluid outlet 216 for discharge of fluid to the internal combustion engine 202. In an embodiment, the filter mount 222 is configured to receive a removable filter assembly (not shown) therein, that includes one or more filter elements (not shown) for filtration of fluid flowing therethrough. Further, a recirculation conduit 234 is connected between the filter outlet 232 and the fluid inlet 214 such that a first recirculation loop 236 is defined. In particular, a portion of fluid flow post filtration enters the internal combustion engine 202 and another portion of fluid flow is received in the recirculation conduit 234 for transfer to the first pump element 220.

The fluid conditioning module 212 further includes a second pump element 238 that is connected in parallel with the filter mount 222 via a set of conduits 240A, 240B. The second pump element 238 has a second pump inlet 242 and a second pump outlet 244. The second pump inlet 242 is in fluid communication with the recirculation conduit 234 via the conduit 240A. The second pump outlet 244 is in fluid communication with the conduit 224B, via the conduit 240B such that a second recirculation loop 243 is defined. Further, the second pump element 238 is configured to draw a portion of the fluid from the recirculation conduit 234, via the conduit 240A while another portion of fluid flows through the recirculation conduit 234. Specifically, the second pump element 238 draws fluid from the recirculation conduit 234 and supplies to the conduit 240B for further filtration by the filter mount 240. In an embodiment, the second pump element 238 includes a second impeller (not shown) that may be rotated at a rotational speed to increase a flow rate and a pressure of the fluid flowing though the second impeller.

In an exemplary embodiment, the second pump element 238 is a centrifugal pump. The second pump element 238 pump may be a single-stage centrifugal pump, a two-stage centrifugal pump, and a multi-stage centrifugal pump. However, it will be appreciated that either the first pump element 220 or the second pump element 238 may be any type of turbomachine, i.e. a positive displacement pump, a centrifugal pump, or may be any other pump known in the art.

In the embodiment of FIG. 2, the fluid conditioning module 212 includes a prime mover 246 operably coupled to the first pump element 220 and the second pump element 238. The prime mover 246 is configured to impart rotational motion to the first impeller in the first pump element 220 and the second impellor in the second pump element 238. The prime mover 246 may be an engine driven pump, a hydraulic power source, a pneumatic power source, or combinations thereof. In an exemplary embodiment, the prime mover 246 is a variable speed electric motor. In another embodiment, the prime mover 246 may be a constant speed electric motor. Further, a power source (not shown), for example a battery, may also be electrically coupled to the prime mover 246.

In an exemplary embodiment, the prime mover 246 may be configured to drive the first impeller and the second impeller continuously for a predetermined time. The prime mover 246 may also be configured to selectively drive each of the first pump element 220 and the second pump element 238. For example, the prime mover 246 may drive the first pump element 220 at a first speed for a first predetermined time and the second pump element 238 at a second speed for a second predetermined time. After the second predetermined time, the prime mover 246 may stop driving the second pump element 238, while may continue to drive the first pump element 220. Moreover, though in the illustrated embodiment the prime mover 246 drives both the first pump element 220 and the second pump element 238, a pair of power sources, similar to the prime mover 246, may be provided to power each of the first pump element 220 and the second pump element 238, independently.

As shown in FIG. 2, the fluid conditioning module 212 also includes a pressure regulator 248 that is provided in the recirculation conduit 234. The pressure regulator 248 has a pressure regulator inlet 250 that is in fluid communication with the fluid outlet 216, and a pressure regulator outlet 252 that is in fluid communication with the recirculation conduit 234 and the conduit 240A. The pressure regulator 248 is configured to maintain a pressure gradient at the fluid outlet 216 such that the fluid may be transferred to the internal combustion engine 202 at a predetermined pressure. In an embodiment, the pressure regulator 248 may include a valve element (not shown) that provides variable restriction to fluid flow, thereby regulating i.e. increasing or decreasing a pressure of fluid flowing therethrough.

The fluid conditioning module 212 further includes a control valve 254 disposed downstream of the pressure regulator 248 in the recirculation conduit 234. The control valve 254 has a first position and a second position. In the first position of the control valve 254, fluid flow is allowed through the recirculation conduit 234. In the second position, fluid flow is allowed through the conduit 240A. The control valve 254 may include a valve element, a valve actuator, and a body. The valve element may be configured to actuate between the first position in which fluid flow to the fluid inlet 214 is allowed, and the second position in which fluid flow to the second pump element 238 is allowed. The valve actuator may be configured to actuate the valve element based on signals and/or user inputs.

The fluid conditioning module 212 includes a controller 256 in operative communication with one or more of the prime mover 246 and the control valve 254. The controller 256 is configured to adjust operation of one or more of the prime mover 246 and the control valve 254, based upon a predetermined parameter. The controller 256 may communicate, via one or more wires and/or wirelessly, with the one or more of the prime mover 246 and the control valve 254 to adjust operation thereof. In the illustrated embodiment of FIG. 2, the controller 256 is in operative communication with each of the prime mover 246, the control valve 254, and the internal combustion engine 202. The controller 256 is configured to actuate the control valve 254 between the first position and the second position, based on the predetermined parameter. In an embodiment, the predetermined parameter is an operating parameter of the internal combustion engine 202. The controller 256 may be configured to detect the priming condition and the normal operating condition of the internal combustion engine 202, based on the operating parameter of the internal combustion engine 202. Alternatively, the controller 256 may also receive user inputs pertaining to a selection of the first position and the second position of the control valve 254. Accordingly, the controller 256 may actuate the control valve 254 in the first position when the internal combustion engine 202 is operating in the normal operating condition and in the second position when the internal combustion engine 202 is operating in the priming condition. Further, the controller 256 is also in operative communication with the prime mover 246. In case of variable speed electric motor, the controller 256 may be configured to vary a rotational speed of the prime mover 246. Thereby, the controller 256 may control an operation of the first pump element 220 and the second pump element 238.

Numerous commercially available microprocessors may be configured to perform the functions of the controller 256. It should be appreciated that the controller 256 may embody a machine microprocessor, for example electronic control module, capable of controlling numerous machine functions. A person of ordinary skill in the art will appreciate that the controller 256 may additionally include other components and may also perform other functions not described herein.

Although the fluid conditioning module 212 is described with reference to the engine system 200, it will be appreciated that the fluid conditioning module 212 may be used to condition other fluids in various other systems, such as a lubrication system, a cooling system, a braking system, a work implement system, an after-treatment system. Accordingly, the fluid conditioning module 212 may also include other components, such as heaters, coolers, sensors, fittings, fluid couplings, accumulators or combinations thereof, which may be beneficial for conditioning the fluid. Moreover, the term "fluid" is used herein to describe gases, liquids, slurries, combinations thereof or other similar matter that tends to flow in response to applied shear stress. Examples of fluids may include, but not limited to, lubrication oil, gasoline, diesel, diesel exhaust fluid, hydraulic oil etc.

Various embodiments disclosed herein are to be taken in the illustrative and explanatory sense, and should in no way be construed as limiting of the present disclosure. All joinder references e.g., attached, affixed, coupled, engaged, connected, and the like are only used to aid the reader's understanding of the present disclosure, and may not create limitations, particularly as to the position, orientation, or use of the systems, processes, and/or methods disclosed herein. Therefore, joinder references, if any, are to be construed broadly. Moreover, such joinder references do not necessarily infer that two elements are directly connected to each other. Moreover, expressions such as "including", "comprising", "incorporating", "consisting of", "containing", "having", and the like, used to describe and claim the present disclosure, are intended to be construed in a non-exclusive manner, namely allowing for components or elements not explicitly described also to be present.

Additionally, all numerical terms, such as, but not limited to, "first", "second", "third", or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in fluid systems in which fluid filtration or other types of fluid conditioning such as, heating, and cooling, are typically desired by recirculating the fluid through the filter mount 222 and such recirculation need to be limited or reduced based on a predetermined parameter.

As disclosed earlier herein, the controller 256 communicates with the internal combustion engine 202. The controller 256 detects the operating condition of the internal combustion engine 202, and accordingly, actuates both the control valve 254 and the prime mover 246. In an example, when the internal combustion engine 202 is operating in the normal operating condition, the controller 256 actuates the control valve 254 in the first position. In the first position, a first portion of fluid post filtration enters the internal combustion engine 202, and a second portion is recirculated to the filter mount 222, via the first recirculation loop 236. Further, the second pump element 238 also draws a third portion of fluid from the recirculation conduit 234 and supplies to the filter mount 222 for further filtration. The fluid may flow multiple times through the filter assembly and the filter elements attached to the filter mount 222 before flowing into the internal combustion engine 202. Thus, fluid quality may improve with each successive pass through the filter mount 222. Further, the controller 256 may also vary the rotational speed of the prime mover 246 based on a desired fluid consumption by the internal combustion engine 202 during the normal operating condition thereof.

Further, when the internal combustion engine 202 is operating in the priming condition, the controller 256 actuates the control valve 254 in the second position, thereby shutting off the first recirculation loop 236. In the second position, all fluid flow after filtration enters the internal combustion engine 202 for combustion. The controller 256 may regulate the rotational speed of the prime mover 246 for obtaining a desired fluid flow through the fluid outlet 216. Therefore, a desired level of fluid filtration and fluid flow may be obtained in different operating conditions of the internal combustion engine 202.

With the use and implementation of the present disclosure, improved fluid filtration, for example fuel filtration, may be obtained, thereby increasing service life and efficiency of the machine 100. Since, the first pump element 220 and the second pump element 238 of the fluid conditioning module 212 drives the fluid through the filter mount 222, a greater filtration beta and a greater filter utilization is obtained with respect to suction type pump-filter configuration. Further, the fluid conditioning module 212 enables decreased sensitivity and greater robustness of the fluid delivery system 204 to elevation by providing increased pressure within the engine system 200. The fluid conditioning module 212 also has less sensitivity and greater robustness to pressure differences in various conduits as the fluid is pumped to the fluid reservoir 206 by the first recirculation loop 236 and the fluid return conduit 211.

Moreover, the fluid delivery system 204 provides easy packaging and simplified operation of the engine system 200. For example, the fluid delivery system 204 may be attached to an engine housing of the internal combustion engine 202. Therefore, the fluid delivery system 204 also provides effective space utilization. Since, the controller 256 of the fluid delivery system 204 may be associated with the operations of the engine system 200, the operation of the engine system 200 may be simplified. Specifically, the fluid delivery system 204 may be conveniently implemented in existing engine systems.

While aspects of the present disclosure have been particularly shown and described with reference to the embodiments above, it will be understood that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

What is claimed is:

1. A fluid conditioning module, having a fluid inlet configured for fluid communication with a fluid reservoir and a fluid outlet, comprising:

a first pump element having a first pump inlet and a first pump outlet, the first pump inlet in fluid communication with the fluid inlet of the module;

a filter mount having a filter inlet and a filter outlet, the filter inlet in fluid communication with the first pump outlet and the filter outlet in fluid communication with the fluid outlet;

a pressure regulator having a pressure regulator inlet and a pressure regulator outlet, the pressure regulator inlet in fluid communication with the filter outlet and the pressure regulator outlet in fluid communication with a recirculation conduit a control valve disposed in the recirculation conduit, the control valve having a first position and a second position, wherein fluid flow is allowed through the recirculation conduit when the control valve is in the first position; and a second pump element having a second pump inlet and a second pump outlet, the second pump inlet in fluid communication with the recirculation conduit and the second pump outlet in fluid communication with the filter inlet.

2. The fluid conditioning module of claim 1, wherein the first pump element comprises a positive displacement pump.

3. The fluid conditioning module of claim 1, wherein the first pump element comprises a centrifugal pump.

4. The fluid conditioning module of claim 1, wherein the second pump element comprises a positive displacement pump.

5. The fluid conditioning module of claim 1, wherein the second pump element comprises a centrifugal pump.

6. The fluid conditioning module of claim 1, wherein the first pump element comprises a positive displacement pump and the second pump element comprises a centrifugal pump.

7. The fluid conditioning module of claim 1, wherein the filter mount is configured to receive a removable filter assembly.

8. The fluid conditioning module of claim 1, wherein the control valve is positioned in the first position during a normal operating condition and in the second position during a priming operating condition.

9. The fluid conditioning module of claim 1 configured to cooperate with a petroleum distillate fluid.

10. A fluid conditioning module, having a fluid inlet configured for fluid communication with a fluid reservoir and a fluid outlet, comprising:

a first pump element having a first pump inlet and a first pump outlet, the first pump inlet in fluid communication with the fluid inlet of the module;

a second pump element having a second pump inlet and a second pump outlet;

a prime mover connected to the first pump element and the second pump element, the prime mover configured to impart rotational motion to a first impeller in the first pump element and a second impeller in the second pump element;

a filter mount having a filter inlet and a filter outlet, the filter inlet in fluid communication with the first pump outlet and the second pump outlet, and the filter outlet in fluid communication with the fluid outlet, the second pump outlet in fluid communication with the filter inlet;

a pressure regulator having a pressure regulator inlet and a pressure regulator outlet, the pressure regulator inlet in fluid communication with the filter outlet and the pressure regulator outlet in fluid communication with a recirculation conduit the second pump inlet in fluid communication with the recirculation conduit;

a control valve disposed in the recirculation conduit, the control valve having a first position and a second position, wherein fluid flow is allowed through the recirculation conduit when the control valve is in the first position; and a controller in operative communication with one or more of the prime mover and the control valve, wherein the controller is configured to adjust operation of one or more of the prime mover and control valve based upon a predetermined parameter.

11. The fluid conditioning module of claim 10, wherein the predetermined parameter is an operating parameter of an internal combustion engine.

12. The fluid conditioning module of claim 10, wherein the filter mount is configured to receive a removable filter assembly.

13. The fluid conditioning module of claim 10, wherein the control valve is positioned in the first position during a normal operating condition and in the second position during a priming operating condition.

14. A fluid delivery system for a machine, the fluid delivery system comprising:

a fluid reservoir; and a fluid conditioning module, having a fluid inlet configured for fluid communication with the fluid reservoir and a fluid outlet, the fluid conditioning module comprising:

a first pump element having a first pump inlet and a first pump outlet, the first pump inlet in fluid communication with the fluid inlet of the module;

a second pump element having a second pump inlet and a second pump outlet;

a prime mover connected to the first pump element and the second pump element, the prime mover configured to impart rotational motion to a first impeller in the first pump element and a second impeller in the second pump element;

a filter mount having a filter inlet and a filter outlet, the filter inlet in fluid communication with the first pump outlet and the second pump outlet, the second pump outlet in fluid communication with the filter inlet, and the filter outlet in fluid communication with the fluid outlet;

a pressure regulator having a pressure regulator inlet and a pressure regulator outlet, the pressure regulator inlet in fluid communication with the filter outlet and the pressure regulator outlet in fluid communication with a recirculation conduit, the second pump inlet in fluid communication with the recirculation conduit;

a control valve disposed in the recirculation conduit, the control valve having a first position and a second position, the control valve is positioned in the first position during a normal operating condition and in the second position during a priming operating condition wherein fluid flow is allowed through the recirculation conduit when the control valve is in the first position; and a controller in operative communication with one or more of the prime mover and the control valve, wherein the controller is configured to adjust operation of one or more of the prime mover and control valve based upon a predetermined parameter.

15. The fluid delivery system of claim 14, wherein the predetermined parameter is an operating parameter of an internal combustion engine.

16. The fluid delivery system of claim 14, wherein the filter mount is configured to receive a removable filter assembly.

17. The fluid delivery system of claim 14, wherein the control valve is positioned in the first position during a normal operating condition and in the second position during a priming operating condition.

18. The fluid delivery system of claim 14, wherein the prime mover is a variable speed electric motor.

* * * * *